US007673488B2

(12) United States Patent
Isayama et al.

(10) Patent No.: US 7,673,488 B2
(45) Date of Patent: Mar. 9, 2010

(54) WIRE WINDING APPARATUS AND METHOD FOR PRODUCING MAGNETIC EXCITATION COIL

(75) Inventors: Masayuki Isayama, Kumamoto (JP); Fumihiro Tateno, Tochigi (JP); Yasuhiro Torigoe, Tochigi (JP)

(73) Assignee: Panasonic Corporation, Osaka (JP)

( * ) Notice: Subject to any disclaimer, the term of this patent is extended or adjusted under 35 U.S.C. 154(b) by 52 days.

(21) Appl. No.: 12/124,663

(22) Filed: May 21, 2008

(65) Prior Publication Data

US 2008/0289717 A1 Nov. 27, 2008

Related U.S. Application Data

(62) Division of application No. 11/115,290, filed on Apr. 27, 2005, now Pat. No. 7,383,010.

(30) Foreign Application Priority Data

May 18, 2004 (JP) ..... 2004-147501
Mar. 9, 2005 (JP) ..... 2005-065999

(51) Int. Cl.
*B21D 37/16* (2006.01)
*B21D 17/02* (2006.01)
*B21F 3/00* (2006.01)

(52) U.S. Cl. ..... 72/342.1; 72/342.94; 72/414; 140/92.1

(58) Field of Classification Search ..... 72/414, 72/128, 135, 342.1, 342.94, 342.96; 140/71.5, 140/71.6, 71 C, 92.1; 29/603.23, 603.24, 29/603.26

See application file for complete search history.

(56) References Cited

U.S. PATENT DOCUMENTS 4,192,170 A * 3/1980 Ferwagner ..... 72/414

(Continued)

FOREIGN PATENT DOCUMENTS

| | | |
|---|---|---|
| JP | 60-263407 A | 12/1985 |
| JP | 2-220325 | 9/1990 |
| JP | 9-026719 | 1/1997 |
| JP | 2002-243545 | 8/2000 |
| JP | 2001-188430 A | 7/2001 |

(Continued)

OTHER PUBLICATIONS

English language Abstract of JP 2001-188430 A, Jul. 10, 2001.

(Continued)

*Primary Examiner*—Dana Ross
*Assistant Examiner*—Debra M Sullivan
(74) *Attorney, Agent, or Firm*—Greenblum & Bernstein, P.L.C.

(57) ABSTRACT

A fixing apparatus of the present invention for an electronic induction heating system includes a heat roller and a magnetic excitation coil that generates Joule heat within the heat roller. The fixing apparatus includes a coil positioner that positions the magnetic excitation coil around a portion of a periphery of the heat roller, a fixing roller that fixes toner image on a recording medium, and a belt that contacts a portion of a periphery of the heat roller and the fixing roller to conduct the generated heat from the heat roller to the fixing roller. The coil positioner further has a surface of first curvature substantially identical to a curvature of a periphery of the heat roller at an opposition area, the opposition area being opposite to a contact area where the heat roller makes contact with the belt. The coil positioner is spaced from the belt by a predetermined distance. The coil positioner further has a first extension extending from a first end of the opposition area of the coil positioner and a second extension extending from a second end of the opposition area of the coil positioner. The first extension and the second extension are spaced from the belt distances larger than the predetermined distance.

16 Claims, 16 Drawing Sheets

U.S. PATENT DOCUMENTS

| | | | | |
|---|---|---|---|---|
| 6,584,298 | B2 | 6/2003 | Omoto et al. | |
| 6,868,709 | B2 * | 3/2005 | Adams et al. | 72/342.92 |
| 6,872,925 | B2 | 3/2005 | Asakura et al. | |
| 6,888,113 | B2 | 5/2005 | Monda et al. | |
| 7,129,448 | B2 | 10/2006 | Matsunaga et al. | |
| 2004/0238530 | A1 | 12/2004 | Nonaka et al. | |

FOREIGN PATENT DOCUMENTS

| | | | |
|---|---|---|---|
| JP | 2002-139933 | A | 5/2002 |
| JP | 2004-094266 | A | 3/2004 |

OTHER PUBLICATIONS

English language Abstract of JP 2004-094266 A, Mar. 25, 2004.
English language Abstract of JP 2002-139933 A, May 17, 2002.
English language Abstract of JP 60-263407 A, Dec. 26, 1985.
English language Abstract of JP 2000-243545, Aug. 9, 2000.
English language Abstract of JP 9-026719, Jan. 28, 1997.
U.S. Appl. No. 11/080,431 to Matsunaga et al.
English language Abstract of JP 2-220325, Sep. 3, 1990.

* cited by examiner

WIRE WINDING APPARATUS AND METHOD FOR PRODUCING MAGNETIC EXCITATION COIL

CROSS-REFERENCE TO RELATED APPLICATIONS

This application is a divisional of U.S. patent application Ser. No. 11/115,290 filed on Apr. 27, 2005, which claims priority to Japanese Application Nos. 2004-147501, filed May 18, 2004 and 2005-065999, filed Mar. 9, 2005, the contents of which are expressly incorporated by reference in their entireties.

BACKGROUND OF THE INVENTION

1. Field of the Invention

The present invention relates to a fixing apparatus for an electronic induction heating system and an image forming apparatus equipped with the fixing apparatus, such as a copying machine, facsimile, or printer which utilize an electrophotography device or an electrostatic recording format. The present invention further relates to a wire winding apparatus and a method for producing a magnetic excitation coil that is utilized for an electronic induction heating system, using the wire winding apparatus.

2. Description of Related Art

Generally, fixing devices installed in an image forming apparatus such as a printer or a copying machine are designed to save energy and operate at high speeds. Because of this, devices equipped with an electromagnetic induction heating type heater can be widely utilized in place of halogen lamps and similar devices. Related electromagnetic induction heating type heaters apply a magnetic field, generated by a magnetic excitation coil, to a heating element which then heats the heating element. As an example, this heater can be used as a fixing device that heats non-fixed images formed on a recording medium such as transfer paper or an OHP sheet.

Related heaters equipped with magnetic excitation coils apply a magnetic field, generated by the magnetic excitation coil, to a cylindrical heat generation roller which in turn generates an eddy current in an electroconductive layer formed by the surface layer of the heat generation roller. The electroconductive layer is then heated by the Joule heat generated by this eddy current. Normally, it is effective to design the shape of the magnetic excitation coil along the outside shape of the cylindrical heat generation roller. Fixing devices which are equipped with heat-resistant endless belts suspended between a fixing roller, a heat generation roller, and both rollers are well known. It is also preferable to closely place a magnetic excitation coil along the heat generation roller and endless belt in a fixing device equipped with this type of endless belt.

In order to stably maintain an approximate cylindrical shape when forming a magnetic excitation coil into an approximate cylindrical shape, from the past, the magnetic excitation coil was changed into the desired shape (semicircular shape) along with a coil shape retaining member (as an example refer to related art 1). Further, when forming the magnetic excitation coil into an approximate cylindrical shape, there is a chance that the temperature distribution of the heating element may not be uniform. In order to make the temperature distribution of the heating element uniform, it has been proposed to partially change the distance between the magnetic excitation coil and the heating element to partially alter the magnetic excitation coil making it more distant from the heating element (as an example refer to related art 2).

[Related Art 1] Japanese Patent Publication 2000-243545
[Related Art 2] Japanese Patent Publication H9-26719

If the diameter of the heat generation roller is made smaller than the fixing roller in a fixing device in which an endless heat-resistant belt is suspended between the fixing roller and the heat generation roller, the endless heat-resistant belt will be expanded into a fan shape towards the fixing roller. In addition, there is a chance that the heat-resistant belt might bulge close to the contact area between the heat generation roller following the rotation of the belt.

Even if the magnetic excitation coil formed in an approximate semicircular shape matching the curvature of the heat generation roller is placed close to the heat generation roller, a problem occurs wherein the edge of the open side of the magnetic excitation coil interferes with the heat-resistant belt that is expanded into a fan shape or the heat-resistant belt that is bulging. In order to avoid interference between the magnetic excitation coil and the heat-resistant belt, the installation range of the magnetic excitation coil can be restricted to contact area L between the heat generation roller and the heat-resistant belt although this does not act in response to the requirement to provide efficient heating up to a range wider than contact area L by closely placing the magnetic excitation coil. Separating the distance between the heat-resistant belt and the magnetic excitation coil enough that they do not interfere with each other in order to avoid interference between the magnetic excitation coil and the heat-resistant belt even further results in a problem of a worsening magnetic bonding between the magnetic excitation coil and the heat generation roller and heat generation loss.

In related art 1, after securing a planar coil shape retaining member on a planar coil winding jig and winding the coil wire on the planar surface of the above-mentioned coil shape retaining member, the coil is pressurized. Then, a substantially planar-shaped coil is heated until reaching a softening temperature together with the coil shape retaining member and changed into a shape that forms the surface of the coil.

When changing the pressurized planar-shaped coil as required together with the coil shape retaining member, the outside applies stress in a direction that compresses the inside towards a direction that stretches the copper wire towards the bending direction of the magnetic excitation coil copper wire wound in a substantially planar shape. As a result, a problem of stress being applied to the insulation cover of the copper wire and the insulation cover deteriorating occurred. In particular, the magnetic excitation coil copper wire used in an induction heater had a remarkable problem because Litz wire was used for this copper wire and this Litz wire used a very thin cooper wire wound several tens of times.

As disclosed in related art 2, if the bending amount of the magnetic excitation coil is utilized to make the heat generation distribution uniform, there as also a problem of more stress being applied to the coil and the stress applied to the insulation cover of the copper wire increasing even more.

SUMMARY OF THE INVENTION

The present invention takes the problems mentioned above into consideration and has the objective of providing a fixing apparatus for an electronic induction heating system and an image forming apparatus equipped with the fixing apparatus that can be placed close to the heat roller and the belt in a range wider than the contact area between the heat roller and the belt without restricting the contact area between the heat roller and the belt.

In order to solve the related problems, a fixing apparatus of the present invention for an electronic induction heating system comprises a heat roller and a magnetic excitation coil that generates Joule heat within the heat roller. The fixing apparatus comprises a coil positioner that positions the magnetic excitation coil around a portion of a periphery of the heat roller, and a fixing roller that fixes toner image on a recording medium. The fixing apparatus comprises a belt that contacts a portion of a periphery of the heat roller and the fixing roller to conduct the generated heat from the heat roller to the fixing roller. The coil positioner further has a surface of first curvature substantially identical to a curvature of a periphery of the heat roller at an opposition area, the opposition area being opposite to a contact area where the heat roller makes contact with the belt. The coil positioner is spaced from the belt by a predetermined distance. The coil positioner further has a first extension extending from a first end of the opposition area of the coil positioner and a second extension extending from a second end of the opposition area of the coil positioner. The first extension and the second extension are spaced from the belt distances larger than the predetermined distance.

Accordingly, a high-precision magnetic excitation coil for induction heating and a manufacturing method thereof can be provided that forms an optimum magnetic field for induction heating matching the shape of the heat-resistant belt.

BRIEF DESCRIPTION OF THE DRAWINGS

The present invention is further described in the detailed description which follows, with reference to the noted plurality of drawings by way of non-limiting examples of exemplary embodiments of the present invention, in which like reference numerals represent similar parts throughout the several views of the drawings, and wherein:

FIG. 3 (*b*) is a cross-section showing a magnetic excitation coil unit of an induction heater in the fixing device of FIG. 2;

FIG. 4 (*b*) is a front view of a simple magnetic excitation coil of the embodiment;

FIG. 4 (*c*) is cross-section F-F of a simple magnetic excitation coil of the embodiment;

FIG. 5 (*b*) is a side view of a magnetic excitation coil, heat generation roller, and heat generation belt related to another modified example;

FIG. 5 (*c*) is a side view of a magnetic excitation coil, heat generation roller, and heat generation belt related to another modified example;

FIG. 7 (*b*) is a cross-section of line G-G;

FIG. 9 (*b*) the shape of a female die related to the embodiment of the present invention;

FIG. 11 (*b*) shows a state after a pressing action in which one part of the end of a winding is ruptured;

FIG. 13 (*b*) is a cross-section of plane A in FIG. 13 (*a*);

FIG. 13 (*c*) is a cross-section of plane A in FIG. 13 (*a*) of a formed magnetic excitation coil;

FIG. 13 (*d*) is a cross-section of plane B in FIG. 13 (*a*);

FIG. 13 (*e*) is a cross-section of plane B in FIG. 13 (*a*) of a formed magnetic excitation coil;

FIG. 14 (*b*) is a cross-section of plane A in FIG. 14 (*a*);

FIG. 14 (*c*) is a cross-section of plane A in FIG. 14 (*a*) of a formed magnetic excitation coil; FIG. 14 (*d*) is a cross-section of plane B in FIG. 14 (*a*);

FIG. 14 (*e*) is a cross-section of plane B FIG. 14 (*a*) of a formed magnetic excitation coil;

FIG. 15 (*b*) shows an example of a cross-section of a female die in the embodiment of the present invention;

FIG. 16 (*b*) is a graph showing the quantity of heat generated on a fixing roller corresponding to the cross-section of FIG. 16 (*a*);

FIG. 17 (*b*) is a graph showing the quantity of heat generated on a fixing roller corresponding to the cross-section of FIG. 17 (*a*).

DETAILED DESCRIPTION OF PREFERRED EMBODIMENTS

Figure 1:
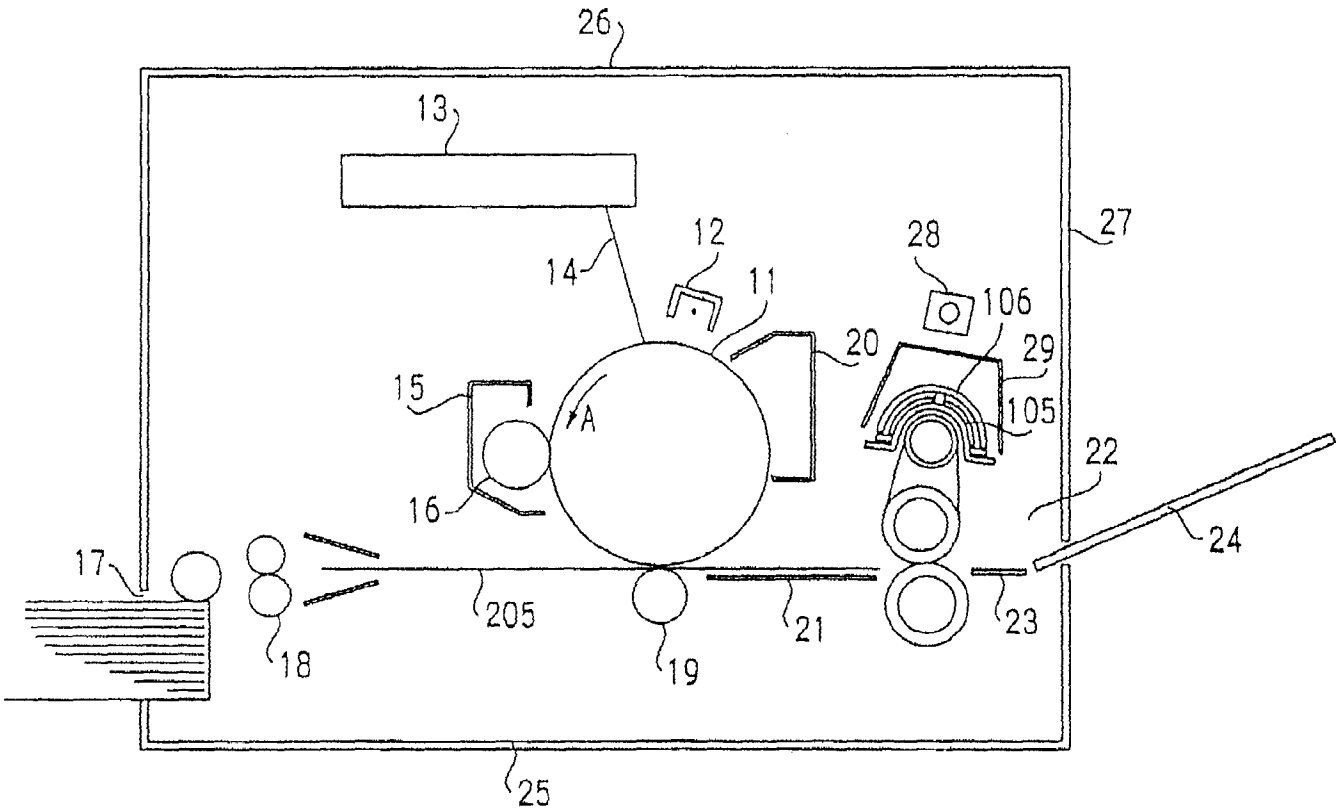
FIG. 1 is a cross-section showing an image forming apparatus that uses a magnetic excitation coil as a fixing device related to the embodiment of the present invention.

In the following, a first embodiment of the present invention will be described in detail referring to the drawings. Identical symbols will not be used nor will descriptions be repeated for compositional elements and corresponding areas which have identical compositions or functions in each drawing.

First Embodiment

In the following, an example of a fixing device will be described as a heater equipped with a magnetic excitation coil.

FIG. 1 is a cross-section showing an image forming apparatus related to the embodiment of the present invention. In FIG. 1, while the electrophotographic photosensitive material (hereinafter referred to photosensitive drum) 11 is rotated at a specified peripheral speed in the direction of the arrow the surface of the photosensitive drum is charged to a negative dark electric potential VO by the charger 12. The beam scanner 13 outputs the laser beam 14 modulated in correspondence to a time series electronic digital picture element signal of an imaging device that is input from an image reading device or a host machine of, for example, a computer (not shown in figure). The surface of the charged photosensitive drum 11 is scanned and exposed by this laser beam 14. Because of this, the exposed portion of the photosensitive drum 11 reduces the electric potential absolute value becoming bright electric potential VL and then an electrostatic latent image is formed. This latent image is developed and made apparent by the negatively charged toner of the developer unit 15.

The developer unit 15 is equipped with the developing roller 16 that is rotated. The developing roller 16 is arranged opposite the photosensitive drum 11 and a thin layer of toner is formed on the outer peripheral surface of the roller. A developing bias is applied to the developing roller 16. The absolute value of the developing bias is smaller than the dark electric potential VO and larger than the bright electric potential VL of the photosensitive drum 11. Because of this, the toner on the developing roller 16 is only transferred to the bright electric potential VL of the photosensitive drum 11 and the latent image is made apparent.

In contrast, the recording medium 205 is fed from the pick-up assembly 17 one sheet at a time and sent to the photosensitive drum 11 and the nip area of the transfer roller 19 via the registration roller pair 18 at a suitable timing synchronized with the rotation of the photosensitive drum 11. Then, the toner image on the photosensitive drum 11 is sequentially transferred to the recording medium 205 by the transfer roller 19 onto which a transfer bias is applied. Any material remaining on the surface of the photosensitive drum 11, such as remaining transfer toner, after the recording medium 205 separates is removed by the cleaning device 20 and repeatedly supplied to the next image formation.

The transfer of the recording medium 205 to the fixing device 22 is guided by the fixing guide 21. After the recording medium 205 is separated from the photosensitive drum 11, it is fed to the fixing device 22. The timer image transferred onto the recording medium 205 is fixed by this action. The recording medium 205 that passed through the fixing device 22 is guided outside the device by the pick-up guide 23. The fixing paper guide 21 and pick-up guide 23 are produced from a resin such as ABS. In addition, the fixing guide 21 and pick-up guide 23 can also be produced by a non-magnetic metal such as aluminum. After the toner image is fixed, the recording medium 205 is guided to the delivery tray 24.

The bottom panel 25 of the device main body, top panel 26 of the device main body, and main body chassis 27 form an integrated unit and support the strength of the entire device. The base material for these members is a magnetic steel and they are produced using a zinc-plated material.

The cooling fan 28 generates an air flow inside the device. The coil cover 29 functions as a cover member and contains a non-magnetic metal such as aluminum and is comprised so as to cover the rear surface of the magnetic excitation coil 105 and the arch core 106.

Figure 2:
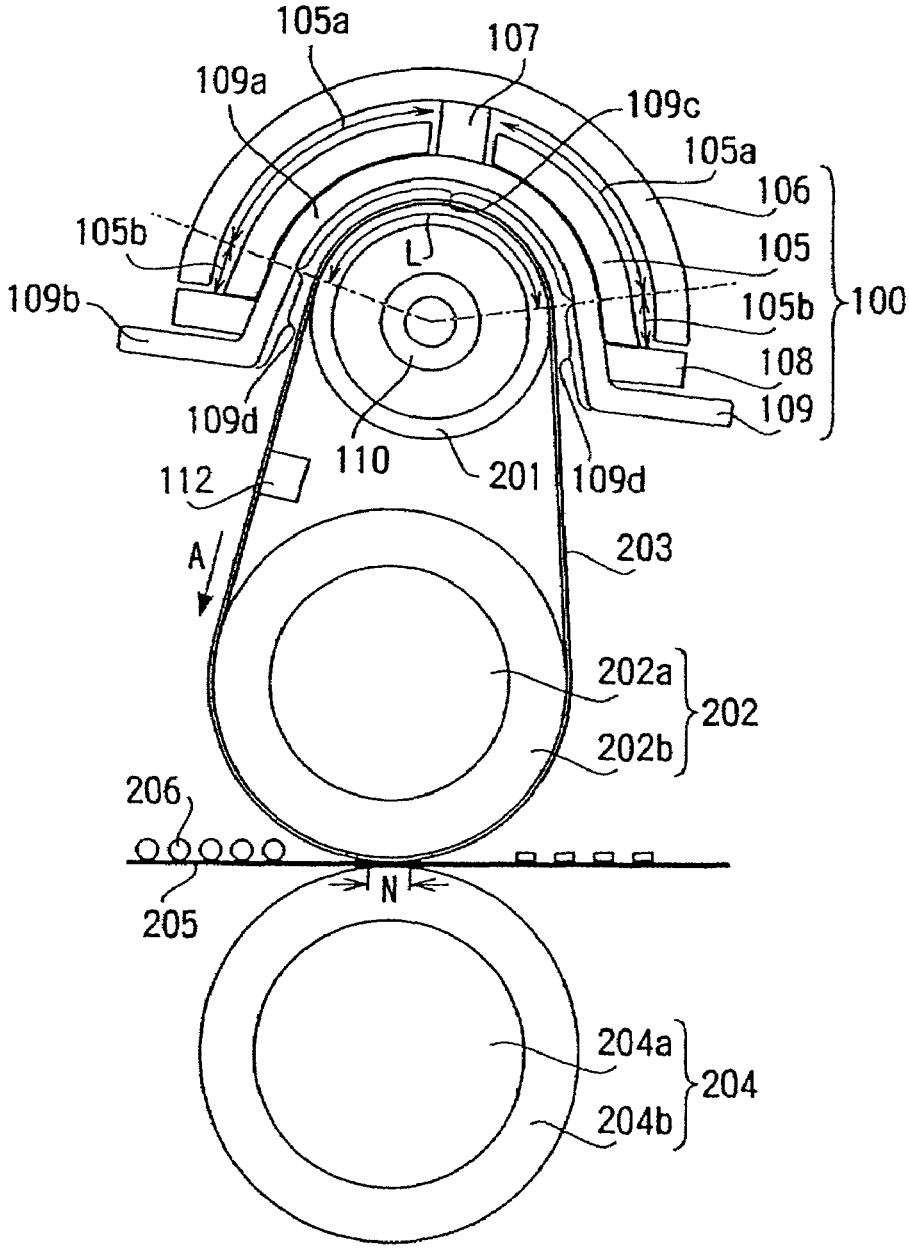
FIG. 2 is a descriptive drawing that shows a fixing device related to the embodiment of the present invention.

Next, the fixing device installed in the image forming apparatus shown in FIG. 1 will be described in detail. FIG. 2 is a side cross-section that shows the construction of the fixing device.

The fixing device shown in FIG. 2 has the heat generation roller 201 that functions as cylindrical first rotating body and the fixing roller 202 placed separate from this heat generation roller 201. The endless heat generation belt 203, that functions as a second rotating body, is suspended between the heat generation roller 201 and the fixing roller 202. The rotation of the fixing roller 202 rotates the heat generation belt 203 in the direction of arrow A. The heat generation belt 203 is pinched against the fixing roller 202 pressure welding the pressure roller 204. By means of pressure welding the pressure roller 204 to the fixing roller 202 a nip area forms between both rollers. The temperature sensor 112, that detects the temperature of the heat generation belt 203, is provided at the center point between the heat generation roller 201 and the fixing roller 202.

In contrast, a magnetic excitation coil unit is provided so as to pinch the heat generation belt 203 and cover at least half of the outer peripheral surface of the heat generation roller 201. The magnetic excitation coil unit is closely placed extending over a wide range from contact area L where the heat generation roller 201 and the heat generation belt 203 make contact up to a region (hereinafter referred to as the non-contact area) that only extends a specified distance at the inlet and outlet side of the heat generation belt 203.

Figure 3:
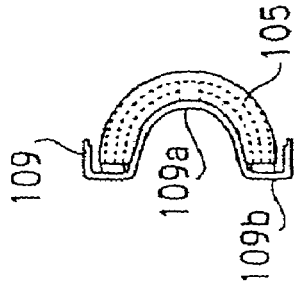
FIG. 3 (*a*) is a top view showing a magnetic excitation coil unit of an induction heater in the fixing device of FIG. 2.
Figure 3:
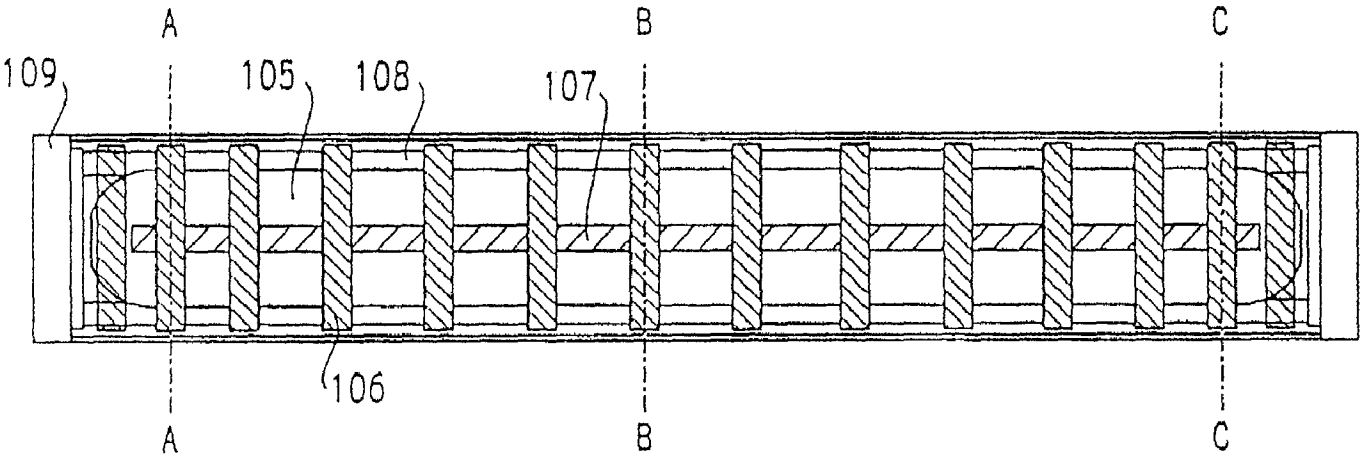
Figure 4:
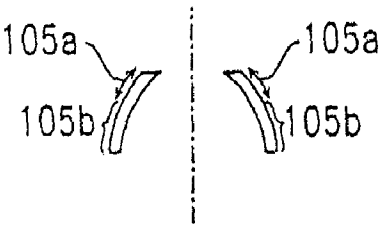
FIG. 4 (*a*) is a perspective view of a simple magnetic excitation coil of the embodiment.
Figure 4:
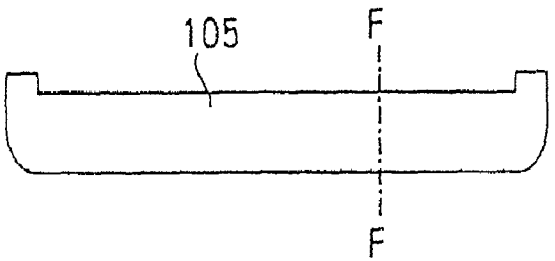
Figure 4:
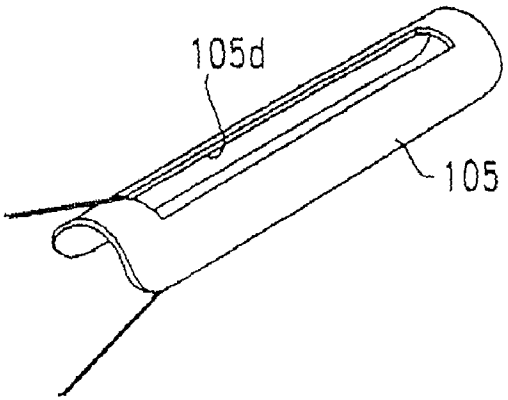

FIG. 3 (*a*) is a top view showing the magnetic excitation coil unit and FIG. 3 (*b*) is a cross-section A-A (or cross-section B-B, cross-section C-C) FIG. 3 (*a*). FIG. 4 (*a*) is an exterior view of the magnetic excitation coil 105, FIG. 4 (*b*) is a front view of the magnetic excitation coil 105, and FIG. 4 (*c*) is cross-section F-F in FIG. 4 (*b*).

The magnetic excitation coil unit has the magnetic excitation coil 105 that generates an alternating magnetic field, the arch core 106 formed in an arch shape that covers the rear surface of the magnetic excitation coil 105, the center core 107 arranged at the winding center of the magnetic excitation coil 105, and the side core 108 arranged at both sides of the winding bundle of the magnetic excitation coil 105. A strong magnetic body such as ferrite or permalloy can be used for the core material.

The center core 107 and side core 108 form a magnetic path along with the arch core 106. Because of this, the majority of the magnetic flux generated by the magnetic excitation coil 105 at the outside of the heat generation belt 203 passes through these three types of cores and reduces the magnetic flux leakage towards the outside of the core. Furthermore, all three types of these cores are not always necessary. One type can be used, a combination, or even no cores. In addition, the center core 107 and side core 108 can be integrated with the arch core 106 or a combination of materials used.

The magnetic excitation coil 105, arch core 106, center core 107, and side core 108 are secured to the coil retaining member 109. The coil retaining member 109 has the semicircular cylinder 109*a* that approximately forms a semicircular cylinder shape, and the flanges 109*b* each of which extend outward from the outer edge of both sides of the semicircular cylinder 109*a* in the horizontal direction. Two long side cores 108 are arranged in both of the flanges 109*b* of the coil retaining member 109. The magnetic excitation coil 105 has a substantially identical shape as the semicircular cylinder 109*a* of the coil retaining member 109 and is placed on the semicircular cylinder 109*a* without being wound on the coil retaining member 109. The magnetic excitation coil 105 forms the opening 105*d* (FIG. 4) along the lengthwise direction in the center of the magnetic excitation coil 105. The center core 107 is placed in this opening 105*d*. Several arch cores 106 are placed at several locations in the lengthwise direction of the coil retaining member 109 in a manner that straddles the magnetic excitation coil 105 and the center core 107.

The coil retaining member 109 also functions as a heat insulating material between the heat generation roller 201 and the magnetic excitation coil 105. The temperature of the heat generation roller portion reaches the fixing temperature of, for example, 170° C. Consequently, the heat radiating towards the adjacent magnetic excitation coil 105 is cutoff by the coil retaining member 109 making it possible to restrict the heat generation of the magnetic excitation coil 105.

The opposing core 110 is placed inside the heat generation roller 201. A strong magnetic body such as ferrite or permalloy can be used for the material of the opposing core 110. Because the opposing core 110 passes through the majority of the magnetic flux generated by the magnetic excitation coil 105, thee is a small amount of magnetic flux leakage towards the outside of the magnetic excitation coil thereby making it possible for the opposing core 110 to effectively utilize the magnetic flux of the magnetic excitation coil.

Here, the shape of the magnetic excitation coil 105 will be described in detail. As described above, because the magnetic excitation coil 105 is placed on the semicircular cylinder 109*a* of the coil retaining member 109, it has a shape substantially identical to the semicircular cylinder 109*a*. The shape of the magnetic excitation coil 105 does not always have to be substantially identical to the semicircular cylinder 109*a* although it is preferable to have an identical shape from the viewpoint of a stable installation.

For the semicircular cylinder 109*a*, the opposing position 109*c*, that is opposite to contact area L (FIG. 2), is formed into a surface of curvature substantially identical to the heat generation roller 201 and extension 109*d*, that extends from the tip of the opposing position 109*c* (opposite to contact area L) up to the flange 109*b*, is placed close to the heat generation belt 203 (expanded into a fan shape towards the fixing roller 202) at an almost fixed distance. However, the extension 109*d* is formed into a substantially planar shape the extends at an angle that does not make contact.

Therefore, even if the heat generation belt 203 is expanded into a fan shape towards the fixing roller 202, because the heat generation roller 201 is smaller than the diameter of the fixing roller 202, the opposing position 109*c* is closely placed at a uniform distance with an identical curvature with respect to contact area L and the extension 109*d* is placed close to the heat generation belt 203 at an almost uniform distance with respect to the non-contact area that extends from the tip of the contact area L to both the inlet and outlet sides.

By making the shape of the magnetic excitation coil 105 substantially identical to the shape of the semicircular cylinder 109*a* of the coil retaining member 109, the magnetic excitation coil 105 can be closely placed at a uniform distance with an identical curvature with respect to contact area L in like manner to the coil retaining member 109 and the magnetic excitation coil 105 can be placed close to the heat generation belt 203 at an almost uniform distance with respect to the non-contact area that extends from the tip of the contact area L to both the inlet and outlet sides.

In other words, as shown in FIG. 4 (*c*), for the magnetic excitation coil 105, the curved surface 105*a*, opposite to the contact area L that has a curvature identical to the heat generation roller 201, is formed with a curvature identical to the heat generation roller 201 and the extension 105*b*, opposite to the non-contact area that extends from the tip of the contact area L to both the inlet and outlet sides, is formed into a substantially planar surface at an almost fixed distance with respect to the heat generation belt 203 that expands into a fan shape.

Because the shape of the magnetic excitation coil 105 is such that it has an identical surface of curvature or a planar surface at each opposing location corresponding to the surface of curvature of contact area L and the surface of curvature of the non-contact area (in this example the planar surface has a curvature of infinite size), the surface area where eddy currents generate which flow in the electroconductive layer on the surface of the heat generation belt 203 can be increased thereby making it possible to increase the amount of heat the heat generation belt 203 generates.

In the fixing device shown in FIG. 2, because the objects where the magnetic field from the magnetic excitation coil was applied were the contact area L that has a uniform curvature and the planar part that expanded into a fan shape, the shape of the magnetic excitation coil 105 (and the coil retaining member 109) were formed with a surface of curvature (105*a*) and a planar surface (105*b*) matching those shapes. When the object where the magnetic field will be applied is a different shape, a combination of a first surface of curvature and a second surface of curvature matching that shape or one part of the extension can be planar and the other part the second surface of curvature that has a curvature different from the first surface of curvature.

Figure 5:
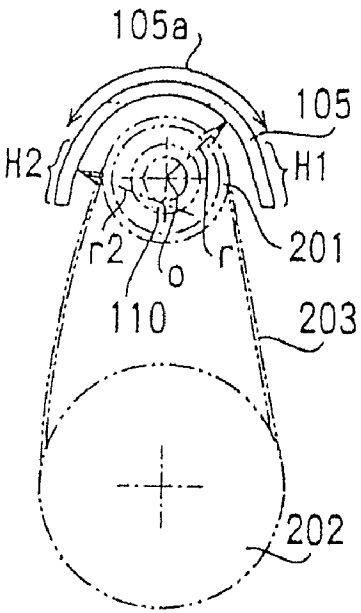
FIG. 5 (*a*) is a side view of a magnetic excitation coil, heat generation roller, and heat generation belt related to a modified example.
Figure 5:
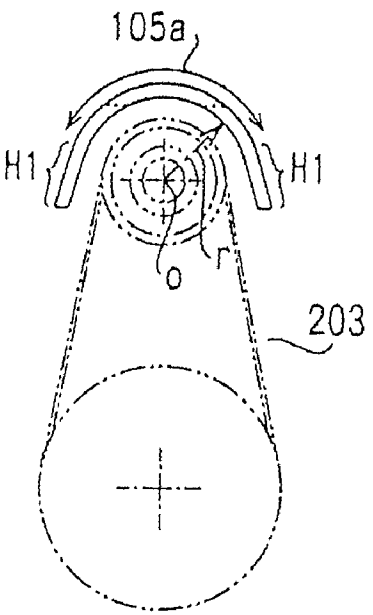
Figure 5:
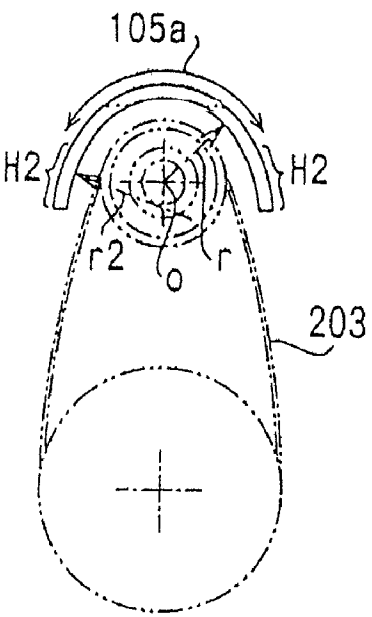

FIG. 5(*a*), (*b*), and (*c*) show modified examples of the shape of the magnetic excitation coil.

For the modified example shown in FIG. 5 (*a*), the extension H1, that extends from the curved surface 105*a* at the belt inlet of the magnetic excitation coil 105, is extended almost parallel to the opposing heat generation belt 203 and forms into a planar surface shape. The extension H2, that extends from the curved surface 105*a* at the belt outlet, is formed by a surface of curvature that has a curvature corresponding to the bulges of the heat generation belt 203.

Depending on the fixing device, there is a chance that bulging may not occur at the belt inlet although bulging might occur on the outside at the belt inlet. In order to be compatible with this type of fixing device, the curvature (includes planar surface) of the left and right extensions H1, H2 must change in response to the condition of the belt. According to the modified example shown in FIG. 5 (*a*), a fixing device that has characteristics in which bulging only occurs on the outside at the belt outlet will constantly maintain the distance between the magnetic excitation coil 105 and the heat generation belt 203 making it possible to apply a uniform magnetic field.

The modified example shown in FIG. 5 (*b*) is an example in which both of the extensions H1, which extend from the curved surface 105*a* in both directions at the belt inlet and the belt outlet of the magnetic excitation coil 105, are extended almost parallel to each opposing heat generation belt 203 and form into a planar surface shape. In particular, the extension H1 extends towards the fixing roller 202 more than the horizontal line where the axis of rotation of the heat generation roller 201 passes. Conventionally, because the entire magnetic excitation coil was formed in a uniform surface of curvature, it is difficult to sufficiently maintain the length. Products of the present invention can sufficiently maintain the length of the extension H1 if bulging does not occur at both the belt inlet and the belt outlet of the magnetic excitation coil 105 as shown in FIG. 5 (*b*). In the modified examples shown in FIGS. 5 (*a*) and (*c*), because the shape of the curvature of the extensions H1, H2 are formed so as to maintain a uniform distance in response to the condition of the belt, the length can be maintained in like manner to the modified example shown in FIG. 5 (*b*).

Because it is possible to uniformly apply a magnetic field with an even wider range than before by sufficiently maintaining the length of the extension H1 in the magnetic excitation coil 105 in this manner, the heat generation efficiency can be improved.

For the modified example shown in FIG. 5 (*c*), the extension H2, that extends from the curved surface 105*a* at the belt inlet of the magnetic excitation coil 105, is formed by a surface of curvature that has a curvature corresponding to the bulges of the opposing heat generation belt 203 and the extension H2, that extends from the curved surface 105*a* at the belt outlet, is formed by a surface of curvature that has a curvature corresponding to the bulges of the opposing heat generation belt 203.

Depending on the fixing device, there is a chance that bulging may occur at both the belt inlet and the belt outlet. In order to be compatible with this type of fixing device, the curvature of the left and right extensions H1, H2 must bend in response to the bulging of the belt. According to the modified example shown in FIG. 5 (*c*), a fixing device that has characteristics in which bulging occurs at both the belt inlet and the belt outlet will constantly maintain the distance between the magnetic excitation coil 105 and the heat generation belt 203 making it possible to apply a uniform magnetic field.

Each extension (H1, H2) in the magnetic excitation coils shown in FIGS. 5 (*a*), (*b*), and (*c*) extends towards the fixing roller side only 5 mm from the horizontal line where the axis of rotation (origin point O) of the heat generation roller 201 passes. The results of the experiment found that the time required to start the heat generation belt 203 up to 170° C. could be shortened. The lengths of the extensions (H1, H2) are preferably 10 mm or less towards the fixing roller side from the horizontal line where the origin point O of the heat generation roller 201 passes. If they exceed 10 mm, the effect of the bond between the opposing core 110 placed inside the heat generation roller 201 will be reduced.

Next, the materials of the compositional elements which comprise the fixing device will be described.

The heat generation roller 201 is formed from, for example, Fe, Ni and a hollow, cylindrical, and strongly magnetic metal material of a Fe, Ni alloy (such as SUS). The outer diameter is, for example, 10 mm to 30 mm, the thickness is, for example, 0.1 mm to 0.2 mm. The composition has a low heat capacity and fast temperature rise.

The fixing roller 202 includes, for example, a metal core 202*a* made from a metal such as SUS and a solid or foam silicon rubber elastic member 202*b* with heat resistant properties that covers the metal core 202*a*. In order to form a contact area (nip area N) with a specified width between the fixing roller 202 and the pressure roller 204 using the pressing force from the pressure roller 204, the outer diameter is 20 mm to 40 mm and is larger than the heat generation roller 201. The thickness of the elastic member 202*b* is 3 mm to 8 mm and the hardness 15° to 50° (Asker C).

Because this makes the heat capacity of the heat generation roller 201 smaller than the heat capacity of the fixing roller 202, the heat generation roller 201 is quickly heated and the warm-up time shortened.

The heat generation belt 203 is produced by dispersing a base material of a conductive powder, such as iron powder, Al powder, silver powder, or copper powder within a polyimide resin that has a glass transition point of 360 (° C.) and forming a very thin endless belt with a diameter, that forms an electroconductive layer, of 30 mm to 60 mm and a thickness of 40 μm to 100 μm. This electroconductive layer can be formed by layering 2 or 3 10 μm thick silver layers. In addition, in order to provide release properties, a 5 μm thick release layer (not shown in the figure), that includes a fluorine resin, can cover the surface of the heat generation belt 203. The glass transition point of the base material of the heat generation belt 203 is preferably in a range of 200 (° C.) to 500 (° C.). Furthermore, an individual or combined resin or rubber with favorable release properties, such as PTFE, PFA, FEP, silicon rubber, or fluorine rubber, can be used for the release layer of the surface of the heat generation belt 203.

A resin that has heat resistant properties, such as a fluorine resin, or a metal, such as an electrocast thin nickel plate and a thin stainless steel plate, can also be used for the base material of the heat generation belt 203 other than the polyimide resin mentioned above. For example, this heat generation belt 203 can have a 10 μm thick copper plating or a 30 μm to 60 μm thick nickel electrocast belt on the surface of 40 μm thick SUS 430 (magnetic) or SUS 304 (non-magnetic).

When the heat generation belt 203 is used as an image heater for heated fixing of monochrome images, just the release properties can be ensured although it is preferable to form a rubber layer to provide elasticity when the heat generation belt 203 is used as an image heater for heated fixing of color images.

The pressure roller 204 is formed from a core metal 204*a* that includes, for example, a cylindrical metal with high thermal conductance such as SUS or Al and an elastic member 204*b*, with high heat resistance and toner release properties, provided on the surface of the core metal 204*a*.

The copper wire used in the magnetic excitation coil 105 is formed by combining 1 to 10 bundles of a Litz wire bundle. The Litz wire bundle consists of wire elements with a diameter of ϕ0.05 to ϕ0.2. The Litz wire bundle use a combination of wire bundles which have a maximum outer diameter of 2 mm and the coil thickness can be 2 mm. In order to correspond to an even thinner coil, the number of wires bundled for one Litz wire bundle can include from 10 to 40 wires. The outer diameter of the Litz wire can be calculated using formula 1 according to JIS C3005.

$$D=1.154\times d\times\sqrt{n} \qquad \text{Formula 1}$$

In the formula D is the outer diameter of the Litz wire, d is the outer diameter of the wire elements, and n is the number of wire elements.

By winding the wire while combining multiple Litz wire bundles, it is possible to wind the wire at both the thick part of the magnetic excitation coil and the thin part of the magnetic excitation coil keeping the winding tight. The electrical resistance of wire element diameters which have a wire diameter larger than ϕ0.2 will become larger due to high-frequency AC current which in turn results in excessive heat generation in the magnetic excitation coil.

In the composition of the fixing device mentioned above, a high-frequency AC current of 10 kHz to 1 MHz or more preferable a high-frequency AC current of 20 kHz to 800 kHz is supplied from a drive power supply (not shown in the figure) to the magnetic excitation coil 105. This AC current generates an alternating magnetic field between the magnetic excitation coil 105, the arch core 106, the center core 107, and the side core 108 and opposing core 110. Then, this alternating magnetic field acts on the heat generation roller 201 at the contact area L between the heat generation roller 201 and the heat generation belt 203 as well as at the non-contact area close to this contact area. An eddy current flows in a direction that impedes changes to the magnetic field inside these areas.

This eddy current generates Joule heat in response to the resistance of the heat generation roller 201 and then the heat generation roller 201 is heated by electromagnetic induction heating at mainly the contact area L between the heat generation roller 201 and the heat generation belt 203 as well as at the non-contact area close to this contact area.

The temperature on the inside surface of the heat generation belt 203 that is heated in this manner is detected by the temperature sensor 112 that contains a high-temperature element with thermal responsiveness, such as a thermistor, at the inlet of the fixing nip area N.

Since the temperature sensor 112 does not scratch the surface of the heat generation belt 203 because of this, the fixing performance is continually ensured along with the temperature directly before entering into the fixing nip area N of the heat generation belt 203 being detected. Thereafter, the temperature of the heat generation belt 203 is stably maintained at, for example, 170° C. by controlling the introduction of electric power to the heater 100 based on signals output which are based on this temperature information.

When the toner image 206, that is formed on the recording medium 205, is introduced into the fixing nip area N at the image forming area (not shown in the figure) provided on the upstream side of the fixing device, the toner image 206 is fed to the fixing nip area N in a state in which the difference between the front surface temperature and the rear surface temperature of the heat generation belt 203, heated by the heater 100 that includes the magnetic excitation coil unit and the heat generation roller 201, become smaller. Because of this, the front surface temperature becomes excessively high compared to the set temperature, namely, it becomes possible to limit overshoot and stably control the temperature.

In the following, the manufacturing method of the magnetic excitation coil will be described.

The manufacture of the wire winding device that initially produces the magnetic excitation coil 105 will be described referring to FIG. 6 to FIG. 11.

Figure 6:
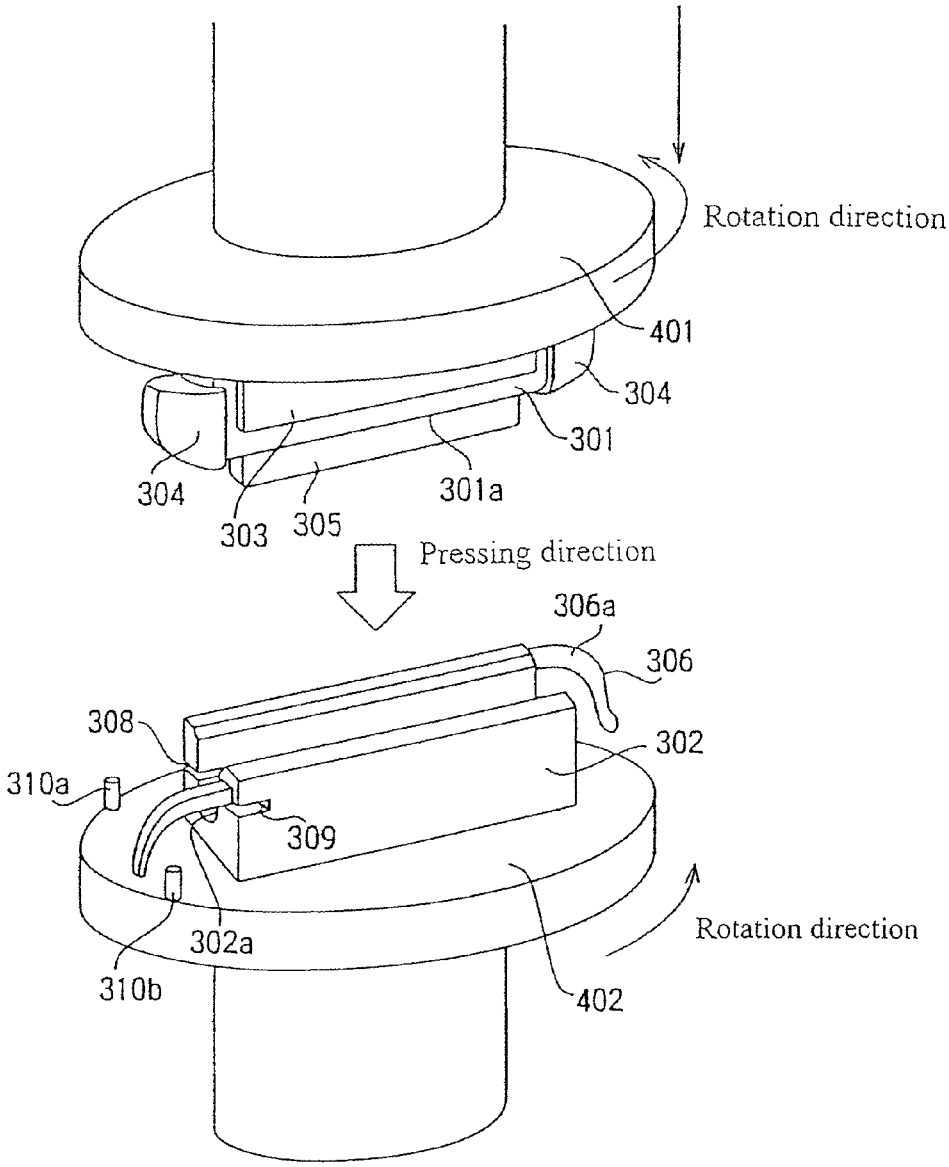
FIG. 6 is a perspective view of a wire winding device related to the embodiment of the present invention.
Figure 7:
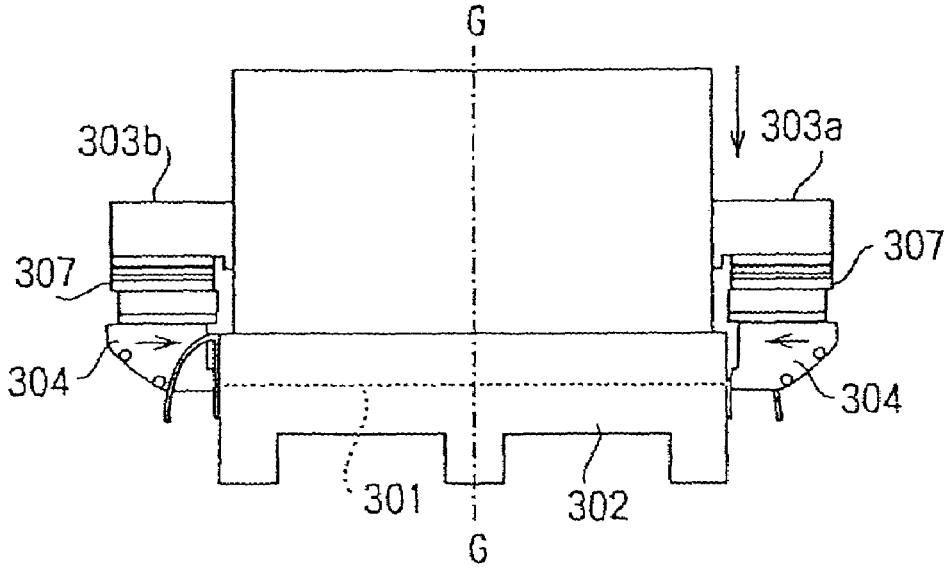
FIG. 7 (*a*) is a side view of the wire winding device shown in FIG. 6.
Figure 7:
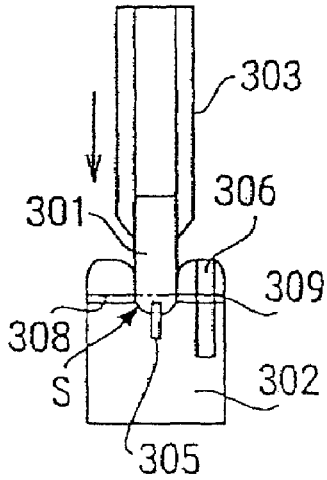
Figure 8:
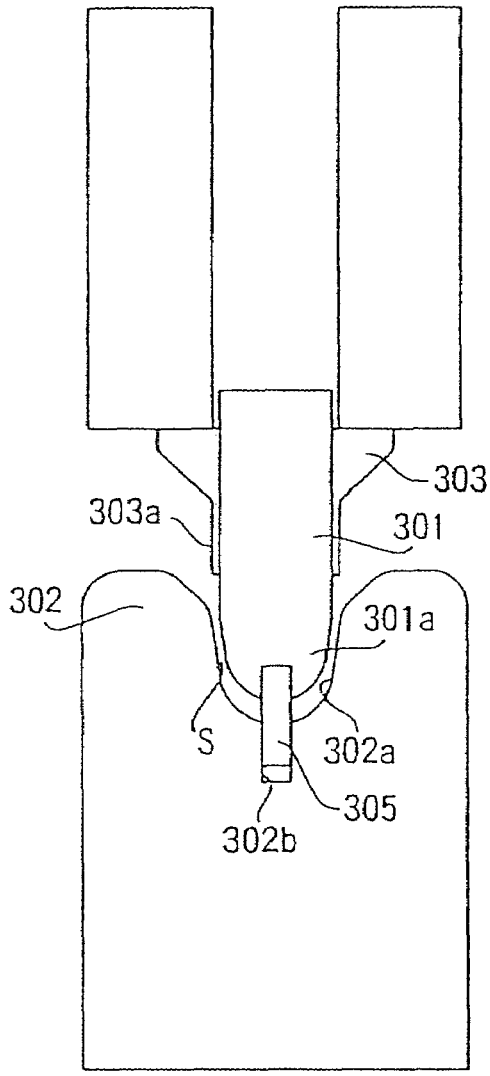
FIG. 8 is an enlarged view of FIG. 7.

FIG. 6 is a perspective view of the wire winding device that produces the magnetic excitation coil 105 mentioned above. The figure shows a state in which the male die and female die are separated. FIGS. 7 (*a*) and (*b*) show states in which the male die and female die are engaged. FIG. 7 (*a*) is a side view and FIG. 7 (*b*) is a cross-section of line G-G in FIG. 7 (*a*). FIG. 8 is an enlarged view of FIG. 7.

The winder has the male die 301, and the female die 302 that forms a wire winding gap S (FIG. 8) between the male die 301 and engages the male die 301.

Figure 9:
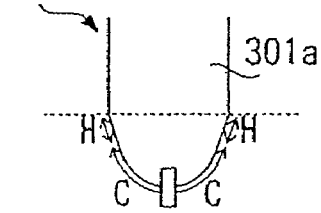
FIG. 9 (*a*) shows the shape of the tip of a male die related to the embodiment of the present invention.
Figure 9:
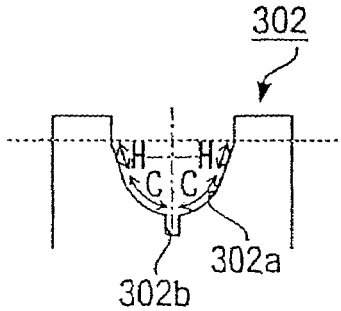

The male die 301 has the semicircular cylinder shaped convex portion 301*a* that extends in an approximate U-shape towards the female die 302 extending over the entire width in the lengthwise direction. FIG. 9 (*a*) shows a cross section of the convex portion 301*a*. The tip (region C) that forms the semicircular cylinder shape of the convex portion 301*a* has a surface of curvature identical to the curvature shape of the contact area L mentioned above. The specified range (region H) that continues upward from this tip (region C) has a planar surface shape that expands into a fan shape at an angle identical to the non-contact area mentioned above. In other words, the shapes are identical to the magnetic excitation coil 105 (product). In addition, when manufacturing the magnetic excitation coil with the shapes shown in FIGS. 5 (*a*), (*b*), and (*c*), using the convex portion 301*a* that has a shape identical to the magnetic excitation coil shown in each figure is obvious.

The center key 305 is provided at the center of the convex portion 301*a* of the male die 301. The first pressing member 303 is arranged on both sides of the convex portion 301*a* so as to freely slide against the side surface of the convex portion 301*a* and male die wire winding guides 304 are arranged separate from the convex portion 301*a* and at both ends in the lengthwise direction of the convex portion 301*a*.

The male die 301 is secured to the rotation plate 401, that can rotate, by the first pressing member 303 within a planar surface that crosses the pressing direction at a right angle. The first pressing member 303 is also secured to a press mounting plate (not shown in the figure) above the wire winding device.

As shown in FIG. 7 (*a*), the male die guide drive members 307 are secured against the mounting members 303*a*, 303*b* which protrude above the male die wire winding guides 304 from the side wall on both sides of the first pressing member 303. The male die guide drive members 307 are comprised by a drive device whose drive source is an air cylinder. Each male die wire winding guide 304 is supported via each male die guide drive member 307.

Figure 11:
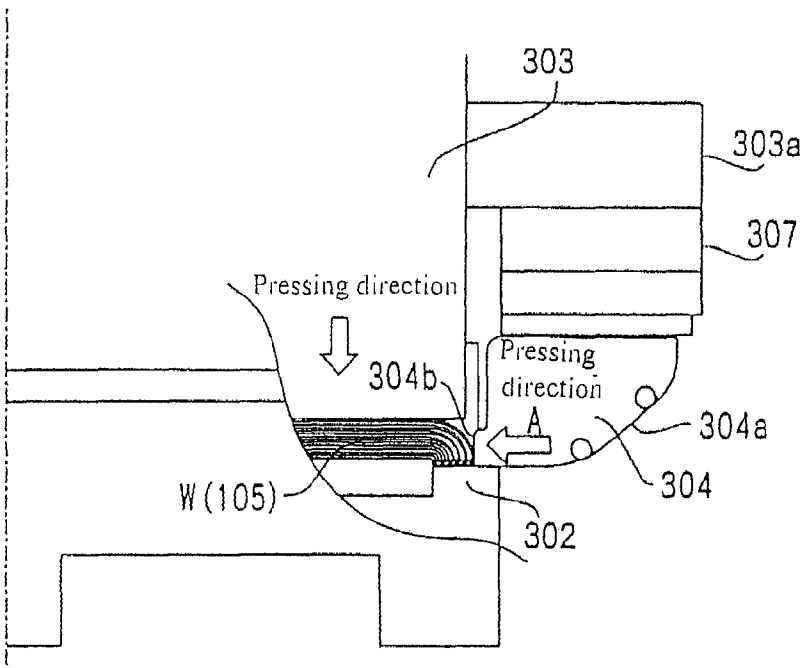
FIG. 11 (*a*) shows a state before a pressing action in which one part of the end of a winding is ruptured.
Figure 11:
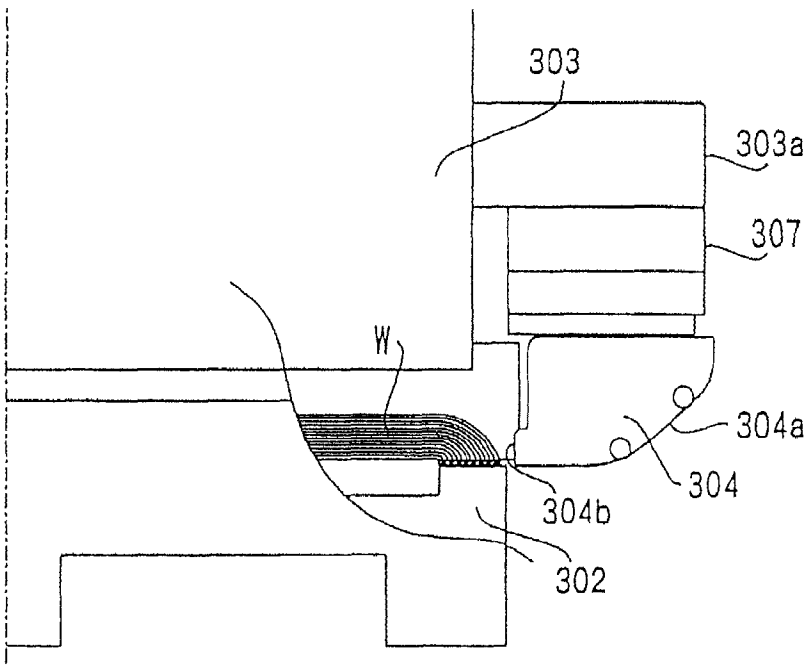

FIGS. 11 (*a*) and (*b*) show the relationship between the copper wire bundle W, embedded in the wire winding gap S, the first pressing member 303, and the male die wire winding guides 304. As shown in the figures, the taper 304*a* is formed on the male die wire winding guide 304 at the side from the upper edge to the lower surface on the mounting side towards the male die guide drive member 307. The taper 304*a* functions to guide the copper wire to the wire winding gap S while winding the wire. Furthermore, the male die wire winding guide 304 has the pressing part 304*b* that presses down on the copper wire bundle that is guided to the wire winding gap S and wound around the convex portion 301*a* when pressing the copper wire bundle from both sides in the lengthwise direction. Each male die guide drive member 307 moves the male die wire winding guide 304 in the direction of arrow A when pressing the copper wire bundle, wound around the convex portion 301*a* of the male die 301, from both sides in the lengthwise direction.

In contrast, as shown in FIG. 8 and FIG. 9 (*b*), the female die 302 has the concave part 302*a* formed in a curved shape surface corresponding to the convex portion 301*a* of the male die 301. A groove 302*b* is provided at the center of the concave part 302*a*. The groove 302*b* engages with the center key 305. The concave part 302*a* of the female die 302 is slightly larger than the convex portion 301*a* of the male die 301 and is designed so as to form the wire winding gap S with a uniform width that allows the wire winding to be inserted between the convex portion 301*a* and the concave part 302*a* when the male die 301 and the female die 302 are engaged as shown in FIG. 8. The thickness of the wire winding gap S is preferably 1 mm to 5 mm.

As shown in FIG. 6, a notches are provided at the ends of both side walls in the lengthwise direction which form the concave part 302*a* of the female die 302 and form the winding start pullout opening 308 and the winding end pullout opening 309. The female die wire winding guide 306 is provided at the end surface of the concave part 302*a* side wall positioned just above the winding end pullout opening 309. In like manner, another female die wire winding guide 306 is provided at the side wall end surface opposite to the concave part 302*a* side wall end surface that forms the winding start pullout opening 308. The female die wire winding guide 306 functions so as to pull up a guide wire once again that dropped into the wire winding gap S due to the male die wire winding guide 304. Because of this, the female die wire winding guide 306 stretches from the mounting position above the concave part 302*a* side wall up to close to the bottom of the wire winding gap S and forms the taper 306*a*.

The lower end of the female die 302 is secured to the rotation plate 402 under the wire winding. One terminal 310*a* of an energized electrode is arranged close to the winding start pullout opening 308 on the upper surface of the rotation plate 402 and another terminal 310*b* of an energized electrode is arranged close to the winding end pullout opening 309.

Here, the shape of the concave part 302*a* formed on the female die 302 will be described. FIG. 9 (*b*) is a cross-section of the concave part 302*a* provided on the female die 302. When the concave part 302*a* engages the male die 301, the surface close to the bottom (region C), that is opposite to the tip (region C) that forms the semicircular cylinder shape of the convex portion 301*a*, has a surface of curvature identical to the curvature shape of the contact area L mentioned above. The specified range (region H) that continues upward from this surface close to the bottom (region C) has a planar surface shape that expands into a fan shape at an angle identical to the non-contact area mentioned above.

The material of the male die 301, the female die 302, the first pressing member 303, and the male die wire winding guide 304 is a metal such as Fe, Al, brass, Fe alloy, or Al alloy.

The surface of the die is protected by a metal plating process or a rust prevention method. This plating can be Ni plating, copy plating, or hardened chrome plating. The die for the female die wire winding guide 306 can be a metal such as Fe, Al, brass or a metal alloy that includes Fe. In addition, metal wire made of Fe, Al or brass can be attached by bending the wire. It is preferable for the playing thickness to be from approximately 1 μm to 10 μm.

Next, the manufacturing method of the magnetic excitation coil using a wire winding device comprised as described above will be described.

When the wire winding device starts at the origin point position of the wire winding device shown in FIG. 6, the male die 301 moves downward until a specified position and then, as shown in FIGS. 7 (*a*), (*b*) and FIG. 8, the male die 301 and the female die 302 engage forming the wire winding gap S between the two. In this example, the wire winding gap S is formed at approximately 1 mm to 5 mm.

Figure 10:
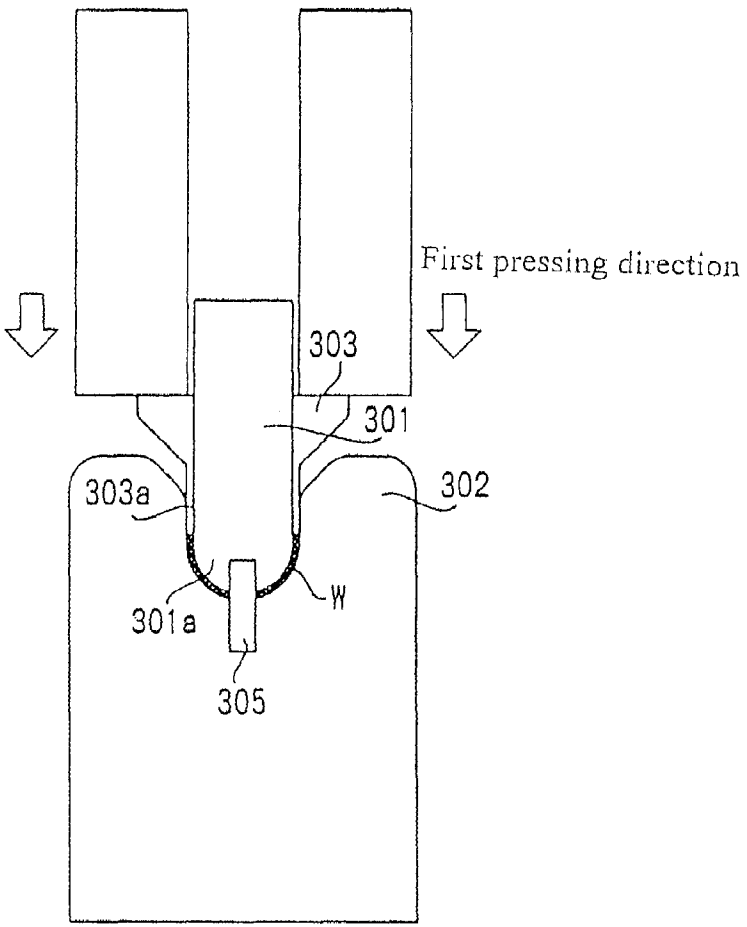
FIG. 10 shows a state after a pressing action by the first pressing member.
Figure 10:
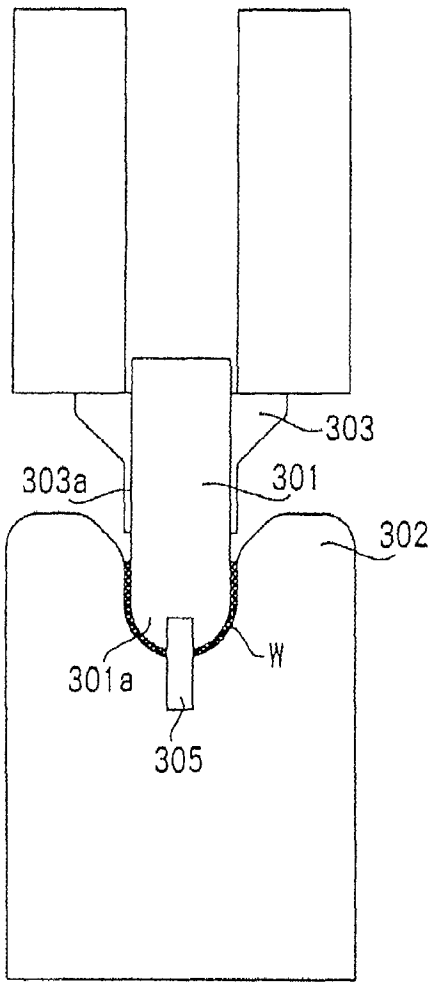

Next, multiple bundles of copper wire are guided to the wire winding gap S and wound around the outer periphery of the convex portion 301*a* filling up the wire winding gap S with copper wire as shown in FIG. 10 (*a*). In more detail, a nozzle (not shown in the figure) simultaneously captures multiple bundles of copper wire and the tip of the copper wire is wound around the energized electrode terminal 310*a* and secured. This cooper wire is hooked on the winding start pullout opening 308 of the female die 302 and the rotation plates 401 and 402 are rotated while the male die 301 and the female die 302 are in an engaged state. As an example, the rotation speed is set to 20 to 200 rotations/minute. If the wire winding speed becomes faster than 200 rotations/minute, the die will shake due to centrifugal force and there will be a chance that the engagement between the male die 301 and the female die 302 might become loose and have an influence on the properties.

When the rotation plates 401 and 402 start rotating, the copper wire is packed and the wire wound in order from the inside of the wire winding gap S by the male die wire winding guide 304 and the female die wire winding guide 306. At this time, when the copper wire, wound by the male die wire winding guide 304, arrives at the end of the winding die (the male die 301 and the female die 302) in the lengthwise direction, the taper 304*a* functions so as to press the copper wire towards the bottom direction of the wire winding gap S. Because of this, the guide wire packed into the wiring die is in a layered state in the horizontal direction at a position opposite to the male die wire winding guide 304 as shown in FIG. 11 (*a*). In contrast, for the female die wire winding guide 306, the taper 306*a* functions so as to raise the copper wire that was pressed down towards the bottom of the wire winding gap S at the end of the winding die (the male die 301 and the female die 302) in the lengthwise direction. Because of this, the copper wire wound on the wiring die is in a layered state in the vertical direction except for both ends as shown in FIG. 11 (*a*).

If the number of specified winds is, for example, 10 turns, the copper wire will be pulled out from the winding end pullout opening 309 and connected to the other energized electrode terminal 310*b*. FIG. 10 (*a*) and FIG. 11 (*a*) show states before the press action just after the copper wire is wound the specified number of winds.

When the winding of the copper wire starts, both of the terminals 310*a* and 310*b*, which are connected to the winding end of the copper wire, are connected to a DC power supply (not shown in the figure). A specified DC current of, for example, 150 A to 250 A flows from this DC power supply to both of the terminals 310*a* and 310*b* for a specified time of, for example, 1.5 seconds to 3.0 seconds. As a result, the temperature of the copper wire rises due to Joule heat flowing in the copper wire and the resin portion of a fusing layer, such as a polyimide that covers the surface of the copper wire, is fused. The heat generation of the copper wire can be calculated using formula 2 shown below.

$$R=\rho\times l\div A$$

$$Q=I^2\times R\times t$$

$$\Delta T=Q\div(m\times C) \qquad \text{Formula}$$

2R: Wire wound coil total resistance, l: Copper wire total length, ρ: Resistance ratio of copper wire, A: Total cross-sectional area of copper wire, Q: Amount of heat generation, t: Energized time, m: Total of copper wire, C: Heat capacity of copper wire, ΔT: Temperature rise of copper wire, I: Energized current.

As shown in FIG. 10 (*b*), after the fusing layer on the surface of the copper wire is. fused, the first pressing member 303 quickly moves up to a specified position on the female die 302 side (downward direction). When the first pressing member 303 moves in the downward direction, the tip pressing part 303*a* of the first pressing member 303, that has a width slightly smaller than the wire winding gap S, slides the inner wall surface of the convex portion 301*a* of the male part 301 which enters into the wire winding gap S and presses the copper wire bundle that is layered inside the wire winding gap S. Because each copper wire, that comprises the copper wire bundle, is fused into a fused layer, the adjacent copper wires are cooled while being held tight under a strong pressure brought about by a first pressing direction performed by the first pressing member 303 and then fused and hardened in that tightly held state. As shown in FIG. 11 (*b*), the copper wire bundle, that is layered in the direction of depth of the wire winding gap S, is pressed in the same direction by pressing in the first direction performed by the first pressing member 303. FIG. 10 (*b*) show a state just after the press action by the first pressing member 303.

The pair of male die wire winding guides 304 are pressed in a second pressing direction, the second pressing member, at the same time as the press in the first pressing direction performed by the first pressing member 303. As shown in FIG. 11 (*b*), the pressing part 304*b* of the male die wire winding guide 304 is opposite to the copper wire at the most outer periphery of the copper wire bundle W that is layered in the horizontal direction in line with the direction of depth of the wire winding gap S. The result of the male die wire winding guides 304 being moved a specified amount towards the direction of the male die 301 by the male die guide drive members 307 is the copper wire bundle, that is pinched between the pressing part 304*b* and the convex portion 301*a* of the male die 301, being pressed towards the second direction (the male die 301 direction). Because each copper wire that comprises the copper wire bundle is fused, into a fused layer, the adjacent copper wires are cooled while being held tight under a strong pressure brought about by a second pressing direction performed by the second pressing member (male die wire winding guide 304) and then fused and hardened in that tightly held state. As shown in FIG. 11 (*b*), the copper wire bundle, that is layered in a direction in line with the direction of depth of the wire winding gap S, is pressed in the same direction by pressing in the second direction performed by the second pressing member (male die wire winding guide 304). The coil length of the magnetic excitation coil is determined by the pressing in the second direction.

Here, the time from just after completing the energizing until the pressing movement starts is preferably set to 3 seconds or less. Then, after the coil assembly is cooled, the male die 301 moves upward until the origin point position and the formed magnetic excitation coil is removed from the winding die (the male die 301 and the female die 302). Here, the cooling method can be natural air cooling or forced air cooling or other methods, such as water cooling, can also be used. The cooling time is preferably 20 seconds or more.

Because the shape of the magnetic excitation coil 105 formed by the related manufacturing process is formed along the coil retaining member 109, the wound wire does not require a process to change the shape to match the coil retaining member 109 thereby making it extremely reliable as well as allowing it to be easily handled and have good productivity because the coil is formed by being securing in the fusing layer of the copper wire without scattering the copper wire even though it is handled by hand.

The length of the magnetic excitation coil 105 in the lengthwise direction with respect to the direction of the axis of rotation of the heat generation roller 201 is adjusted by movable dimensions of the male die wire winding guides 304 in a manner such that the length of the heat generation belt 203 and the heat generation roller 201 become lengths identical to the adjacent regions.

Accordingly, the region of the heat generation roller 201 heated through electromagnetic induction heating by the magnetic excitation unit is at the maximum and the time the surface of the heat generation roller 201 and the heat generation belt 203 are adjacent is also at the maximum. Because of this, the heat transmission efficiency is improved.

Figure 12:
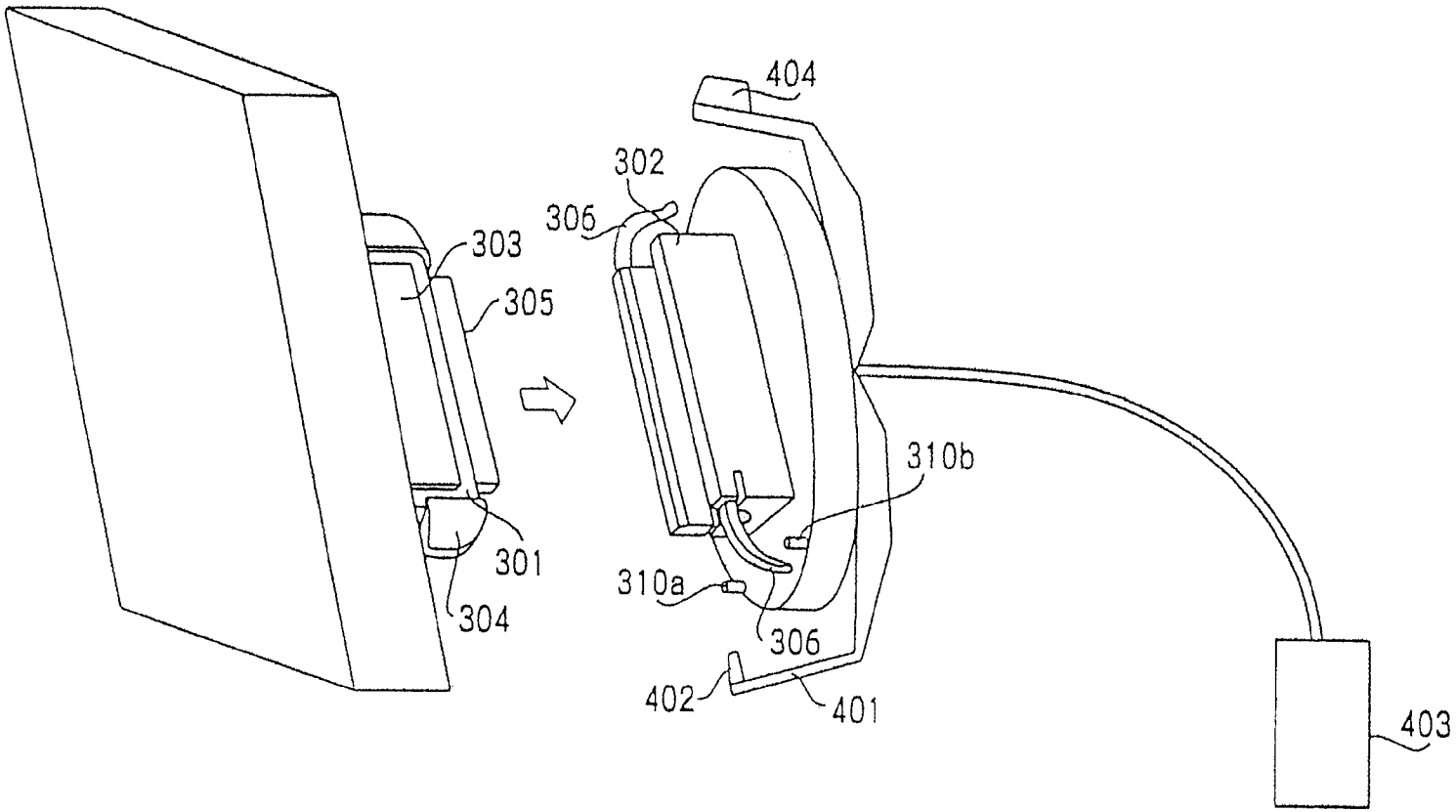
FIG. 12 is a perspective view of a wire winding device related to the embodiment of the present invention.

FIG. 12 is an external appearance view showing a type of wire winding device different from the wire winding device shown in FIG. 6. The same symbols are used for compositional elements identical to each part of the wire winding device shown in FIG. 6.

The wire winding device shown in FIG. 6 used a method to wind the copper wire in order from the inside within the winds of the winding die by placing the male die 301 and the female die 302 above the rotating rotation plate and then rotating the rotation plate. The wire winding device shown in FIG. 12, however, is constructed in a manner such that the winding die is placed above a secured plate and the flyer 401 is provided. The copper wire passes through the nozzle 402 provided at the tip of the flyer 401 thereby winding the wire on the winding die. Although the basic winding die is not changed in this construction, the construction can use a harder material compared to the winding die making it possible to increase the wire winding speed and improve the productivity.

According to the manufacturing method of the magnetic excitation coil mentioned above, electrical current flows in the copper wire packed within the winds, the fusing layer of the copper wire is fused, and then the coil is formed by a pressing action. Thereafter, the coil is cooled and the fusing hardened. The benefit of this is a very stable shape of the magnetic excitation coil after being formed. Even if the thickness of the magnetic excitation coil is not uniform, it is an integrated unit with a stable shape. It is difficult to obtain a stable shape like the product of the present invention in a conventional manufacturing method of the magnetic excitation coil because the coil is forcefully bent into a bent surface shape after being pressed. Even further, if the thickness of the magnetic excitation coil is not uniform, the instability of the shape will also increase.

In contrast, even of the distance between the magnetic excitation coil and the heat generation belt (heat generation roller) can be fixed, a non-uniform temperature distribution will occur in the heat generation belt due to the properties of the fixing device. According to the manufacturing method of the magnetic excitation coil of the present invention, it is possible to design a uniform temperature distribution for this type of fixing device by changing the shape of the winding die of this magnetic excitation coil at areas where the amount of heat generated is high and thinly forming the die.

Figure 13:
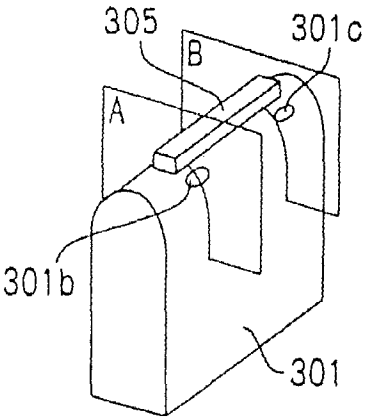
FIG. 13 (*a*) is an exterior view in which the shape of the convex portion of the male die is partially modified.
Figure 13:
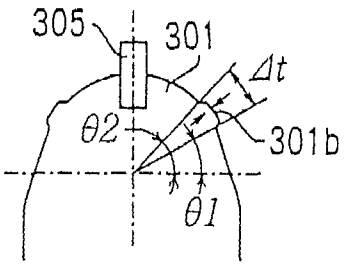
Figure 13:
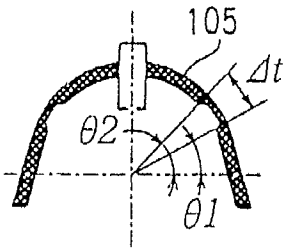
Figure 13:
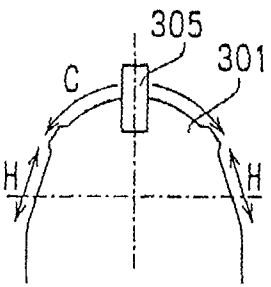
Figure 13:
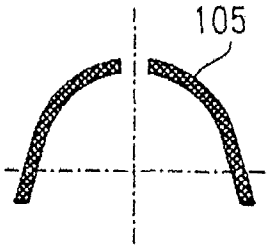

FIGS. 13 (*a*) to (*e*) show partially modified examples of the convex portion 301*a* of the male die 301. FIG. 13 (*b*) shows a cross-section of plane A in FIG. 13 (*a*) and FIG. 13 (*d*) shows a cross-section of plane B in FIG. 13 (*a*). The same symbols are used for parts identical to the male die 301 shown in FIG. 9 (*a*). The female die 302 is identical to the part shown in FIG. 9 (*b*).

As shown in FIG. 13 (*a*), extensions 301*a*, 301*c* are provided at two required locations with the objective of making the thickness of these required positions of the magnetic excitation coil thinner. Although the result is to make the thickness of the required positions thinner as the height of the extensions 301*a*, 301*c* becomes higher, the width of the wire winding gap S formed between the engaged male die 301 and female die 302 must be made lower.

FIG. 13 (*c*) shows a sate in which the copper wire is wound on the male die 301 that has the extensions 301*a*, 301*c*. The thickness of the magnetic excitation coil 105 after being formed becomes thinner than other areas within a range Δt where the extensions 301*a*, 301*c* are formed.

In contrast, as shown in FIG. 13 (*d*), because positions outside the required positions where the thickness must be made thinner are formed in two regions (C, H) with different curvatures as described above, the magnetic excitation coil has a uniform thickness as shown in FIG. 13 (*e*) and two regions (C, H) with different curvatures are formed.

In addition, the manufacturing method of the magnetic excitation coil that uses the male die 301 shown in FIG. 13 (*a*) is the same as the method described above with electrical current flowing in the copper wire packed within the winds, the fusing layer of the copper wire being fused, and then the coil being formed by a pressing action. Thereafter, the coil is cooled and the fusing hardened.

Figure 14:
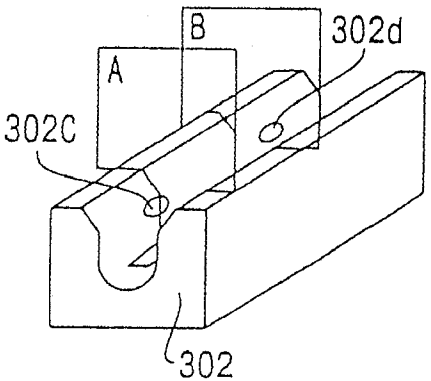
FIG. 14 (*a*) is an exterior view in which the shape of the convex portion of the female die is partially modified.
Figure 14:
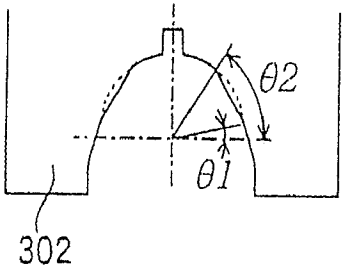
Figure 14:
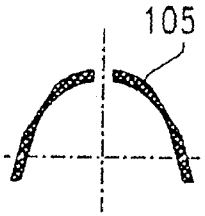
Figure 14:
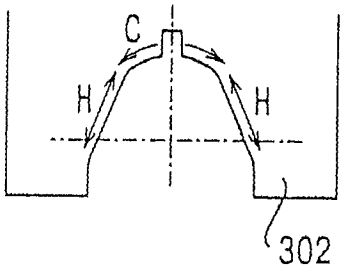
Figure 14:
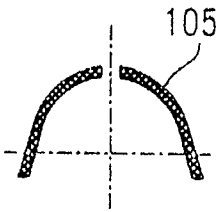

FIG. 14 (*a*) to (*e*) show partially modified examples of the concave portion 302*a* of the female die 302. FIG. 14 (*b*) shows a cross-section of plane A in FIG. 14 (*a*) and FIG. 14 (*d*) shows a cross-section of plane B in FIG. 14 (*a*). The same symbols are used for parts identical to the female die 302 shown in FIG. 9 (*b*). The male die 301 is identical to the part shown in FIG. 9 (*a*).

As shown in FIG. 14 (*a*), bulges 302*c*, 302*d* are provided at two required locations with the objective of making the thickness of these required positions of the magnetic excitation coil thinner. Although the result is to make the thickness of the required positions thinner as the height of the bulges 302*c*, 302*d* becomes higher, the width of the wire winding gap S formed between the engaged male die 301 and female die 302 must be made lower.

FIG. 14 (*c*) is a cross-section of plane A of the magnetic excitation coil manufactured using the female die 302 that has the bulges 302*c*, 302*d*. The thickness of the magnetic excitation coil 105 after being formed becomes thinner than other areas where the bulges 302*c*, 302*d* are formed.

As shown in FIG. 14 (*d*), because positions outside the required positions where the thickness must be made thinner are formed in two regions (C, H) with different curvatures as described above, the magnetic excitation coil has a uniform thickness as shown in FIG. 14 (*e*) and two regions (C, H) with different curvatures are formed.

In addition, the manufacturing method of the magnetic excitation coil that uses the female die 302 shown in FIG. 14 (*a*) is the same as the method described above with electrical current flowing in the copper wire packed within the winds, the fusing layer of the copper wire being fused, and then the coil being formed by a pressing action. Thereafter, the coil is cooled and the fusing hardened.

Figure 15:
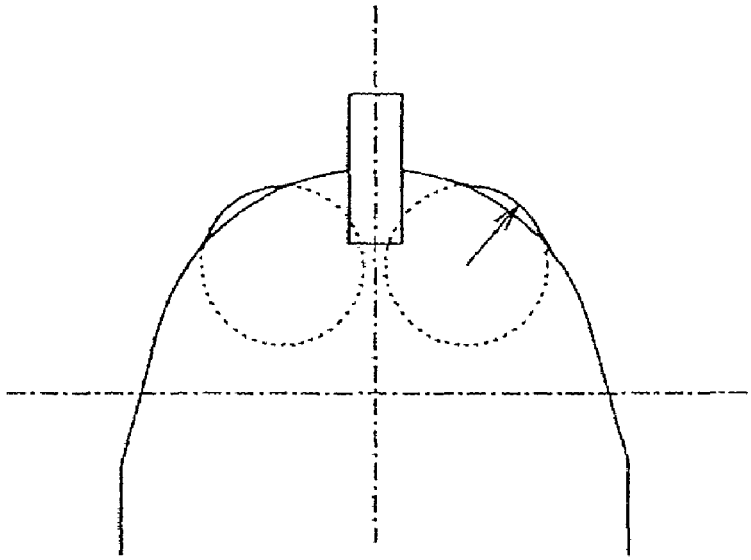
FIG. 15 (*a*) shows an example of a cross-section of a male die in the embodiment of the present invention.
Figure 15:
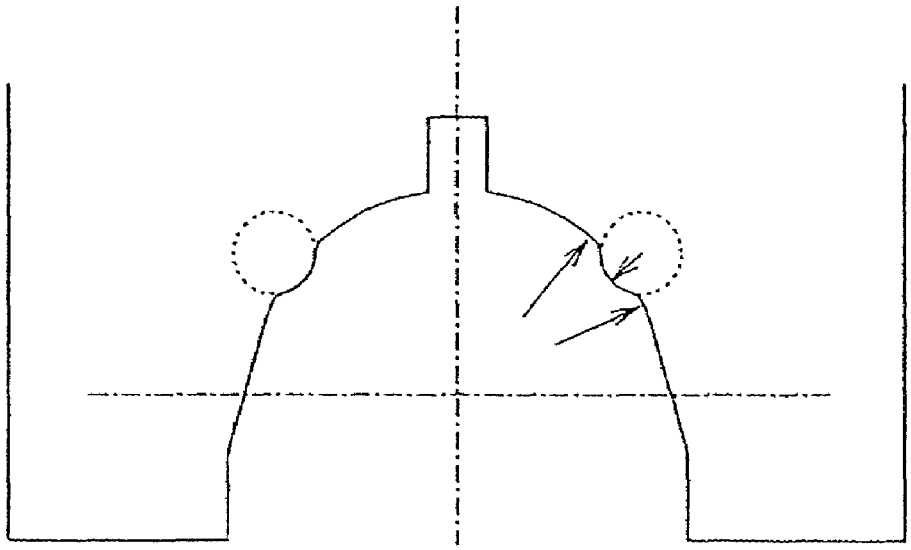

FIG. 15 (*a*) shows an example of a cross-section of the male die 301. A protrusion provided on the convex surface of the male die 301 is made into a circular arc shape. Several circular arc shaped protrusions can be provided. FIG. 15 (*b*) shows an example of a cross-section of the female die 302. A bulge provided on the concave surface of the female die 302 is made into a circular arc shape. The composition can also be such that the circular arc shaped bulge and the original curved line portion are linked by a circular arc.

Although methods which partially modify the shape of the die were described in the descriptions above, there is a tendency for the temperature of the heat generation belt used in the fixing device to drop due to heat radiation of the ends that travels from the center of the belt to the ends. Consequently, it is possible to unify the temperature across the entire heating element of the fixing assembly by providing a composition that continuously changes the value of Δt from the center to the ends.

Figure 16:
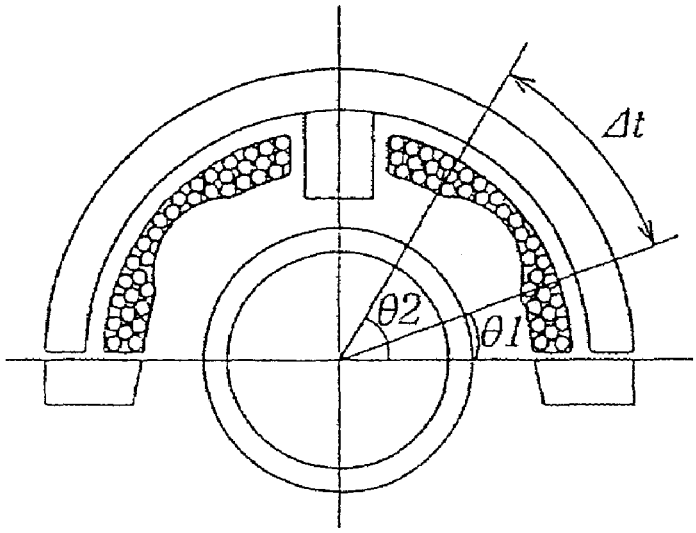
FIG. 16 (*a*) is a cross-section of a heater with a modified coil thickness related to the embodiment of the present invention.
Figure 16:
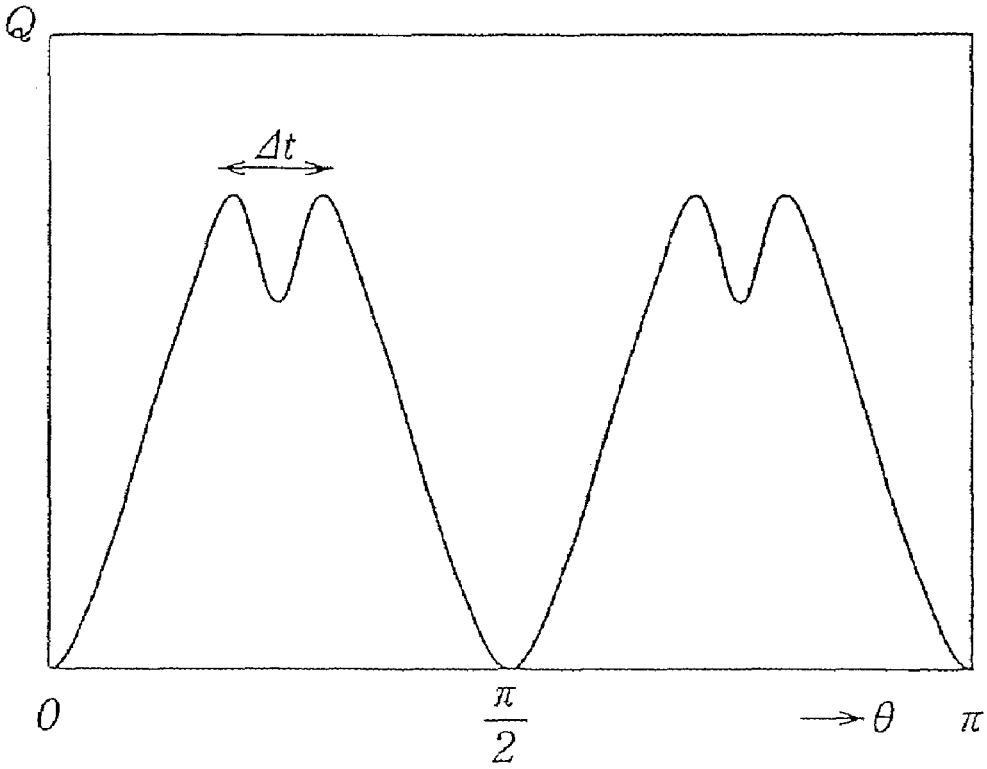

FIG. 16 (*a*) shows a cross-section of a magnetic excitation coil unit in which the thickness of the magnetic excitation coil was made thinner. When the thickness of the magnetic excitation coil is made partially (Δt) thinner in this manner, the amount of heat generated on the fixing roller has the heat generation distribution shown in FIG. 16 (*b*). In this manner, the amount of heat generated at the area that was made partially (Δt) thin is reduced.

Figure 17:
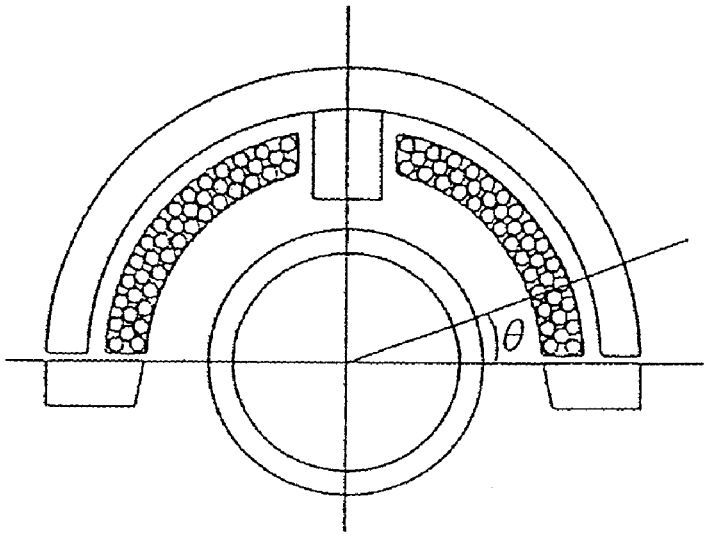
FIG. 17 (*a*) is a cross-section of a heater with a uniform coil thickness.
Figure 17:
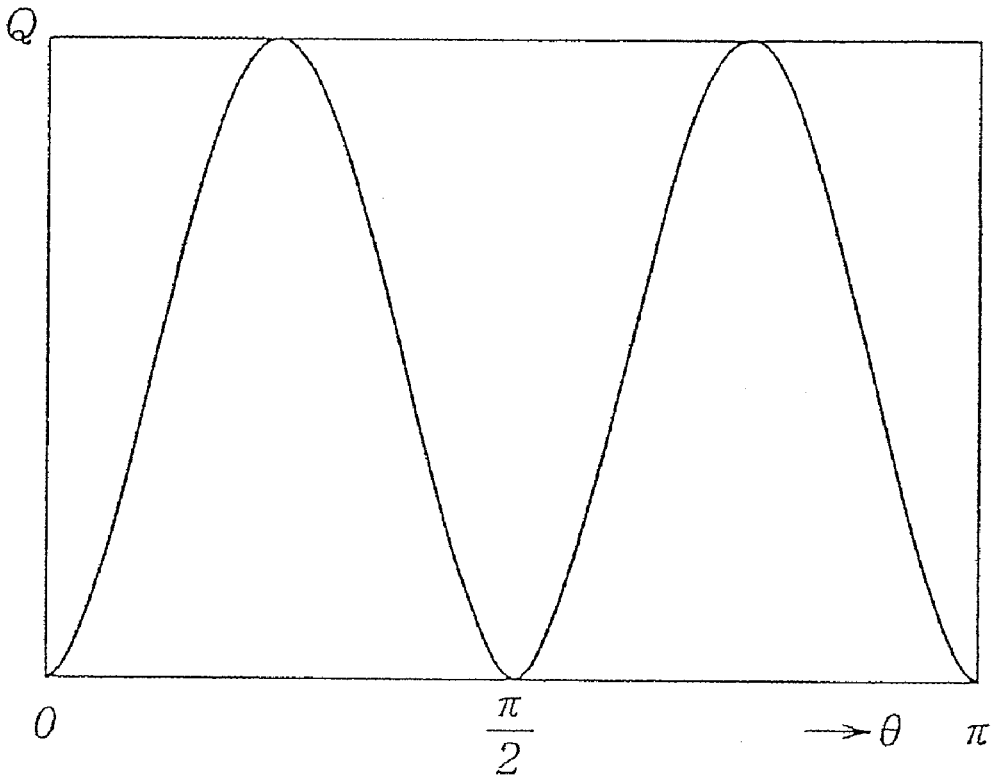

FIG. 17 (*a*) shows a cross-section of a magnetic excitation coil unit with a uniform magnetic excitation coil thickness. The amount of heat generated on the fixing roller when the magnetic excitation coil thickness is made uniform becomes the best at the center of the magnetic excitation coil (FIG. 17 (*b*)).

By adjusting the thickness of the magnetic excitation coil in this manner, the temperature of the heating element can be adjusted thereby making it possible to reduce the eddy current quantity and finely adjust the temperature of the heating element across the entire lengthwise direction.

Consequently, when partial uneven temperature distribution occurs in the heat generation belt of the fixing device, the area where the amount of heat generation is high can be finely adjusted by changing the shape of the winding of the previous magnetic excitation coil.

Although a composition was described in which one part of the shape of the winding (either the male die 301 and the female die 302) is changed in the embodiment mentioned above, a composition can also be applied in which the cap of the die is changed in both the male die 301 and the female die 302.

A composition was described in this embodiment in which only the thickness of the curved shape surface of the male die 301 or the female die 302 was made larger although different compositions can also be used as long as the gap of the winding die is made narrow. For example, several combinations of a composition that combine a circular arc and a straight line can be used in like manner to FIG. 14.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

The present invention is not limited to the above described embodiments, and various variations and modifications may be possible without departing from the scope of the present invention.

This application is based on the Japanese Patent Application No. 2004-147501 filed on May 18, 2004 and the Japanese Patent Application No. 2005-65999 filed on Mar. 9, 2005 entire content of which is expressly incorporated by reference herein.

What is claimed is:

1. A wire winding apparatus for producing a magnetic excitation coil, comprising:

a male die configured for a wire to be wound thereabout, a shape of the male die corresponding to an inside shape of the magnetic excitation coil;

a female die configured to be moved towards the male die, a shape of the female die corresponding to an outside shape of the magnetic excitation coil; and a controller configured to:

move the male die towards the female die;

form a predetermined gap between the male die and the female die;

guide a wire with a surface coating into the predetermined gap;

wind the wire around the male die;

supply current to the wire wound around the male die;

fuse the surface coating of the wound wire due to Joule heat, the Joule heat being generated by the supply of the current to the wound wire;

press the wound wire with the fused surface between the male die and the female die into a predetermined shape; and cool the pressed copper wire to fix the cooled copper wire in the predetermined shape.

2. The wire winding apparatus according to claim 1, wherein the magnetic excitation coil is utilized for a heating apparatus using an electronic induction heating system.

3. A method for producing a magnetic excitation coil using a wire winding apparatus, the wire winding apparatus comprising a male die and a female die, a shape of the male die corresponding to an inside shape of the magnetic excitation coil, and a shape of the female die corresponding to an outside shape of the magnetic excitation coil, the method comprising:

moving the male die towards the female die;

forming a predetermined gap between the male die and the female die;

guiding a wire with a surface coating into the predetermined gap;

winding the wire around the male die;

supplying current to the wire wound around the male die;

fusing the surface coating of the wound wire due to Joule heat, the Joule heat being generated by the supply of the current to the wound wire;

pressing the wound wire with the fused surface between the male die and the female die into a predetermined shape; and cooling the pressed wire to fix the cooled wire in the predetermined shape.

4. The method according to claim 3, wherein the magnetic excitation coil being utilized for a heating apparatus using an electronic induction heating system.

5. A manufacturing apparatus for a magnetic excitation coil, the magnetic excitation coil comprising a wire having a fusing layer and being used for heating a heat roller of a fixer, the manufacturing apparatus comprising:

a male die that has a convex portion, the convex portion having a curvature corresponding to a surface of the heat roller;

a female die that has a concave portion having a shape corresponding to a shape of the convex portion;

a guide that guides the wire into a gap between the convex and concave portions to wind the wire around the convex portion;

an electrode that provides a current to the winded wire to fuse the fusing layer of the winded wire; and a press part that presses the winded wire after the fusing layer is fused.

6. The manufacturing apparatus according to claim 5, wherein the press part presses the magnetic excitation coil in a first direction perpendicular to a longitudinal direction of the excitation coil.

7. The manufacturing apparatus according to claim 6, further comprising a second press part, the second press part pressing the excitation coil in a second direction parallel to the longitudinal direction of the excitation coil.

8. The manufacturing apparatus according to claim 5, wherein the convex portion has a protruding portion.

9. The manufacturing apparatus according to claim 5, wherein the concave portion has a protruding portion.

10. The manufacturing apparatus according to claim 5, wherein the convex portion has a first protruding portion and the concave portion has a second protruding portion.

11. A manufacturing apparatus for a magnetic excitation coil, the magnetic excitation coil comprising a wire having a fusing layer and being used for heating a heat roller of a fixer, the manufacturing apparatus comprising:

a male die that has a convex portion, the convex portion having a first portion and a second portion, the first portion having a first curvature corresponding to a surface of the heat roller and the second portion having a second curvature different from the first curvature;

a female die that has a concave portion;

a guide that guides the wire into a gap between the convex and concave portions to wind the wire around the convex portion;

an electrode that provides a current to the winded wire to fuse the fusing layer of the winded wire; and a press part that presses the winded wire after the fusing layer is fused.

12. The manufacturing apparatus according to claim 11, wherein the press part presses the magnetic excitation coil in a first direction perpendicular to a longitudinal direction of the excitation coil.

13. The manufacturing apparatus according to claim 12, further comprising a second press part, the second press part pressing the excitation coil in a second direction parallel to the longitudinal direction of the excitation coil.

14. The manufacturing apparatus according to claim 11, wherein the convex portion has a protruding portion.

15. The manufacturing apparatus according to claim 11, wherein the concave portion has a protruding portion.

16. The manufacturing apparatus according to claim 11, wherein the convex portion has a first protruding portion and the concave portion has a second protruding portion.

* * * * *